United States Patent [19]

Wojtecki et al.

[11] 4,346,277

[45] Aug. 24, 1982

[54] PACKAGED ELECTRICAL HEATING ELEMENT

[75] Inventors: Rudolph G. Wojtecki, Mantua; Joseph P. Kaan, Stow, both of Ohio

[73] Assignee: Eaton Corporation, Cleveland, Ohio

[21] Appl. No.: 256,442

[22] Filed: Apr. 22, 1981

Related U.S. Application Data

[63] Continuation of Ser. No. 89,651, Oct. 29, 1979, Pat. No. 4,314,144.

[51] Int. Cl.[3] ..... H05B 3/34

[52] U.S. Cl. ..... 219/528; 219/301; 219/345; 219/530; 219/526; 219/540; 219/542; 219/549

[58] Field of Search ..... 219/211, 212, 213, 217, 219/300, 301, 311, 345, 526, 527, 528, 529, 530, 535, 536, 540, 541, 542, 543, 545, 548, 549, 552; 174/75 R, 103; 165/164; 338/210, 211, 212, 213, 214; 138/103

[56] References Cited

U.S. PATENT DOCUMENTS

| | | | |
|---|---|---|---|
| Re. 29,332 | 8/1977 | Bilbro et al. | 165/164 |
| 2,579,383 | 12/1951 | Goudsmit | 219/211 |
| 3,010,007 | 11/1961 | Theodore et al. | 219/345 |
| 3,153,140 | 10/1964 | Theodore et al. | 219/549 |
| 3,156,813 | 11/1964 | Trainer | 219/526 |
| 3,257,498 | 6/1966 | Kahn | 174/75 R |
| 3,331,946 | 7/1967 | Bilbro | 219/535 |
| 3,393,297 | 7/1968 | Hart | 219/528 |
| 3,398,262 | 8/1968 | Kahn | 219/301 |
| 3,543,803 | 12/1970 | Chrow | 219/301 X |
| 3,975,617 | 8/1976 | Othmer | 219/300 |
| 4,056,704 | 11/1977 | Shimuzu | 219/528 |
| 4,058,704 | 11/1977 | Shimuzu | 219/528 |
| 4,139,763 | 2/1979 | McMullan et al. | 219/528 |
| 4,152,577 | 5/1979 | Leavines | 219/301 |
| 4,197,449 | 4/1980 | Fessenden | 219/549 |
| 4,220,848 | 9/1980 | McMullan et al. | 219/528 |

*Primary Examiner*—Volodymyr Y. Mayewsky
*Attorney, Agent, or Firm*—C. H. Grace; W. A. Chrow

[57] ABSTRACT

An elongate flexible package (10) adapted to contain and either enhance or contribute to the control of the heating efficiency of an elongate heating element contained therein and having sufficient flexibility to conform to the item to be heated to which it is secured. Package 10 is provided with a first layer (1) made from a flexible heat conductive or heat insulative material and a second layer (2) made from a heat insulative material that is secured along the length of package 10 to the side of first layer (1) that faces away from the item to be heated to which package (10) is secured. A third protective layer (3) is disposed over second layer (2) and a cavity (4) enclosed by a portion to the walls of layers (1), (2) and (3) extends along the length of package (10) having a cross-sectional configuration adapted to contain and permit the heating element to be axially inserted into or removed from package (10) without having to remove package (10) from the item to which it is secured. Layers (1), (2) and (3) are preferably adhesively secured together and means are provided for securing package (1) to the item to be heated.

9 Claims, 5 Drawing Figures

PACKAGED ELECTRICAL HEATING ELEMENT

This is a continuation of application Ser. No. 89,651, filed Oct. 29, 1979, now U.S. Pat. No. 4,314,144.

INTRODUCTION

This invention relates generally to a means for securing an elongate flexible electrical heating element to an item to be heated, such as a pipe, and more particularly to an elongate flexible package adapted to contain and enhance the heating efficiency of the heating element in conjunction with permitting the heating element to be axially inserted into and removed from the package without having to remove the package from the item to which it is secured.

BACKGROUND OF THE INVENTION

As a result of prolonged usage of flexible heating elements, it sometimes occurs that a particular element fails and needs to be replaced or repaired. In instances where the flexible heating element is secured by cement or adhesives directly to the item to be heated, the removal of the heater often requires a great deal of manual labor and may result in destruction of the heater. Where the heater is mechanically secured directly to the item by clamps or the like, removal of the heater generally requires disassembly of the entire heater-mechanical connection assembly in order to replace or repair the failed element. Another disadvantage of mechanical connecting systems is that they often consist of multiple parts requiring high replacement inventory and, dependent upon their particular design, are often difficult to assembly and disassemble. A further disadvantage of both cementing or adhesively or mechanically securing the heating element directly to the item is that such systems require complete disassembly in order to change the heating capacity of the element if such is required. Other disadvantages of such systems designed to either adhesively or mechanically secure a heating element directly to the item to be heated is that they in many cases do not themselves provide a means of thermally insulating the heating element so as to enhance the element's heating efficiency and often such systems are unable to adapt to irregular shaped surfaces.

Examples of the heaters of the type heretofore described that are designed to be directly secured to the items to be heated by adhesives can be found, for example, in U.S. Pat. Nos. 2,669,646; 3,757,087; and 4,058,704. Examples of heaters of the type heretofore described as secured directly to the item by means of mechanical connectors can be found in U.S. Pat. Nos. 3,257,498; 3,398,262; and 3,971,416.

In contrast to past practice, the present invention provides an elongate flexible packaged enclosure for containing an elongate electrical heating element that is designed to enhance the thermal heating efficiency of the electrical heater and permit the heating element to be axially removed from and inserted into the package for replacement and repair without having to remove the package from the item to which it is secured.

SUMMARY OF THE INVENTION

Accordingly, it is an object of this invention to provide a flexible package adapted to contain an electrical heating element and secure the element to the item to be heated.

It is a further object of this invention to provide a flexible package adapted to contain an electrical heating element and permit the element to be easily and conveniently inserted into and withdrawn from the package for replacement and repair after the package has been secured to the item to be heated.

It is yet another object of this invention to provide a packaged electrical heating element whereby the heating element is contained in the package prior to securing the package to the item to be heated and the combination can be easily secured to the item to be heated in a single operation.

It is yet a further object of this invention to provide a flexible package of the type of the foregoing objects that provides a means of enhancing the thermal efficiency of the heating element.

It is still a further object of this invention to provide a flexible package of the type of the foregoing objects that is able to secure the heating element to straight or irregular surfaces.

It is yet another object of this invention to provide a flexible heating package of the type of the foregoing objects which may be simple and inexpensive to produce.

DETAILED DESCRIPTION OF PREFERRED EMBODIMENTS

Figure 1:
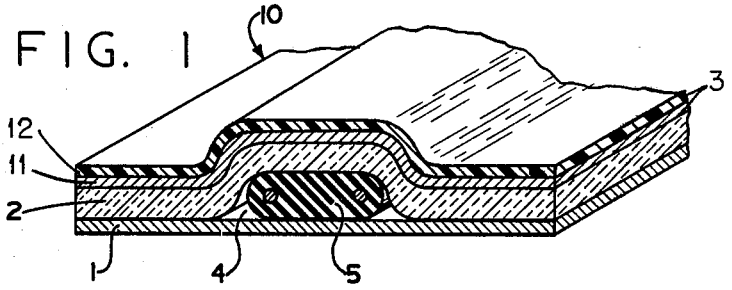
FIG. 1 shows a perspective view of a fragmented section of an embodiment of the invention.

FIG. 1 shows an embodiment of package 10 of the invention in which an elongate electrical heating element 5 in the form of a cable is disposed within cavity 4 extending axially along the length of package 10. Cavity 4 is suitably sized in cross-sectional configuration to contain electrical heating element 5. Cavity 4 is enclosed on one side by a portion of the wall of first layer 1 disposed between element 5 and the item to which package 10 is to be secured. In the embodiment shown, layer 1 is made from a flexible heat conducting material such as copper foil. Layer 1 has sufficient thickness and strength to provide the integrity required to suitably contain element 5 and to permit the handling of package 10 with or without element 5 contained in cavity 4 and to permit element 5 to be axially inserted into and removed from cavity 4 for replacement or repair in conjunction with having sufficient flexibility to permit package 10 to conform to the surface of the item to which it is to be secured.

The balance of the wall enclosing cavity 4 is provided by a portion of flexible composite wall comprising an inner flexible second layer 2, disposed adjacent to cavity 4, that is made from a flexible heat insulating material and an outer flexible protective heat resistant layer 3 disposed on the side of layer 2 that faces away from layer 1. Layer 3 is made from a flexible material such as a flexible metal or metal containing laminate. In the embodiment shown, layer 3 is made from an aluminum foil 11 laminated to a mylar film 12 with the film disposed along the length of package 10 on the side of layer 3 that faces away from layer 2. Layer 2 has sufficient thickness to provide the amount of insulation desired and has sufficient flexibility to provide a portion of the wall of cavity 4 as previously described in conjunction with having sufficient integrity to permit element 5 to be axially inserted into and removed from cavity 4 for replacement or repair. A suitably selected flexible fibrous glass or polymeric foam insulation may be used to provide layer 2. Layer 2 is secured to the spaced apart edges of layer 1 along the length of package 10 excepting in the region of cavity 4. Layer 2 may be secured to layers 1 and 3 by any suitable heat resistant means that does not prevent package 10 from being able to conform to the item to which it is secured. Layer 2 is preferably secured to layers 1 and 3 by means of a suitably selected flexible heat resistant adhesive or adhesives.

The embodiment of the invention shown in FIG. 1 is adapted to be secured to the item to be heated by any suitable means provided that such means is sufficiently adaptable to permit element 5 to be axially inserted into or removed from cavity 4 without having to remove package 10 from the item to which it is secured. The embodiment of FIG. 1 may be secured to the outer surface of a pipe by straps or clamps provided that such straps or clamps do not compress or otherwise distort package 10 to the extent that element 5 cannot be axially inserted into and removed from cavity 4. A preferred method of securing the embodiment of FIG. 1 to an item to be heated is by means of a heat transfer cement or adhesive suitably selected to secure the materials of which layer 1 and the item to be heated is respectively made in conjunction with having the flexibility and heat transfer characteristic and other properties of interest desired for the particular application.

Figure 2:
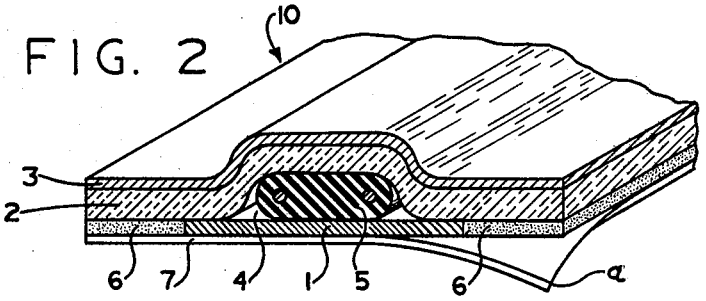
FIGS. 2 and 3 show perspective views of fragmented sections of embodiments of the invention featuring means for adhesively securing the invention to an item to be heated.

FIG. 2 shows a preferred embodiment of the invention in which cavity 4 extends axially along the length of package 10 and has a cross-sectional configuration adapted to contain and permit axial insertion into and removal therefrom of electrical heating element 5. As in the embodiment of FIG. 1, cavity 4 is enclosed on one side by a portion of the wall of layer 1 disposed between element 5 and the item to which package 10 is to be secured. Layer 1 is made from a flexible heat conductive material previously described. Unlike the embodiment of FIG. 1, layer 1 does not extend to the edges of package 10 but is narrow enough in width to provide a longitudinally extending space along the length of package 10 between the edges of layer 1 and the edges of layer 2. The spaces thus provided are filled with a suitable flexible heat resistant cement or adhesive, such as a contact adhesive, shown as spaced-apart longitudinally extending layers 6 in FIG. 2. As in the embodiment of FIG. 1, the balance of cavity 4 is enclosed by a portion of a composite wall comprising layers 2 and 3 previously described. In the event that layers 6 are unable to bond to both layer 2 and the item to which package 10 is to be attached, intermediate layers of suitable adhesives (not shown) may be disposed between layers 6 and 2 as required. Release strip 7 is disposed along the length of package 10 on the side of layers 6 and 1 that face away from cavity 4. Release strip 7 is useful in that it permits package 10 to be conveniently handled and stored, such as, for example, in coiled form, without having package 10 becoming adhered to itself or to other objects prior to its securement to the item to be heated. Release strip 7 may be made of any suitable material such as, for example, a paper having the ability to release from the adhesive employed in layer 6. FIG. 2 also illustrates at "a" where release strip 7 has been pulled away from layers 6 and first layer 1 during the process of securing package 10 to the item to be heated.

Figure 3:
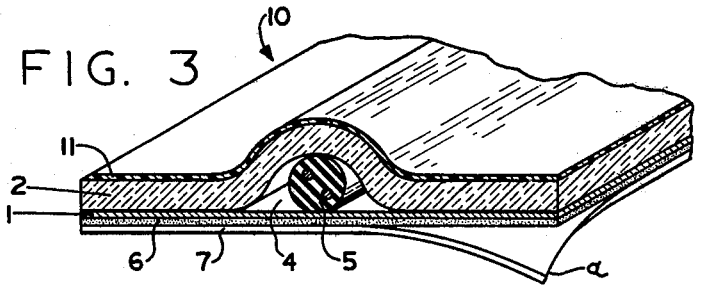

FIG. 3 shows an embodiment of the invention in which layer 3 of the embodiments of FIGS. 1 and 2 is absent and in which adhesive layer 6 extends across the entire width of package 10. As in all embodiments of the invention, cavity 4 extends axially along the length of package 10 and has a cross-sectional configuration adapted to contain and permit axial insertion into and removal from cavity 4 of the particular electrical heating element desired to be used. In the embodiment shown, element 5 disposed in cavity 4 has a circular cross-sectional shape and the cross-sectional configuration of cavity 4 has been formed such that it suitably adapts to such shape. First layer 1 extends across the width of package 10 and is made from a flexible heat conducting material previously described. A portion of the wall of layer 1 provides the wall of cavity 4 that is disposed between element 5 and the item to which package 10 is to be secured. The balance of the wall enclosing cavity 4 is provided by a portion of second layer 2 made from a heat insulating material previously described excepting that layer 2 is from a material that has integral skin 13 on the surface thereof that faces away from cavity 4. Surface skins, such as skin 13, are commonly associated with certain types of foam insulations and can be utilized in embodiments of the invention where suitable. Layer 2 is secured to the spaced-apart edges of layer 1 along the length of package 10 by any suitable means, as previously described, and in conjunction with first layer 1 is formed to provide cavity 4. Layer 6 extends across the width of the surface of layer 1 that faces the item to which package 10 is to be secured. Layer 6 is made from a suitable heat conducting cement or adhesive since it is disposed on the surface of the wall of layer 1 that is disposed between element 5 and the item to which package 10 is to be secured. Release strip 7, previously described, covers the surface of layer 6 facing away from layer 1 and is pulled away therefrom for illustrative purposes at "a" as previously described.

Figure 4:
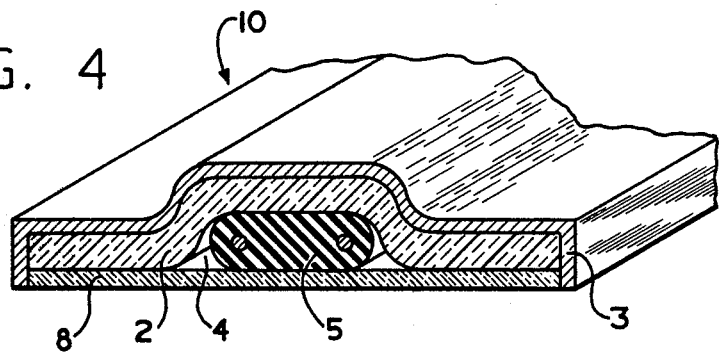
FIG. 4 shows a perspective view of a fragmented section of an embodiment of the invention featuring a heat insulating surface interposed between the electrical heater and the item to be heated.

FIG. 4 shows an embodiment of the invention in which previously described heat conducting first layer 1 has been replaced by heat insulating first layer 8 to provide a means for controlling the amount of heat transferred from the electrical heating element contained in cavity 4 and the item being heated. Layer 8 is made from a heat insulating material that is sufficiently flexible for layer 8 to conform to the item to which package 10 is to be secured in conjunction with the heat insulating characteristics desired combined with sufficient integrity such that package 10 can be reasonably handled with or without the presence of element 5 in cavity 4 and is able to withstand the effect of axially inserting element 5 into and withdrawing element 5 from cavity 4 in the event that it becomes necessary to repair or replace element 5. Second layer 2 is made from a flexible heat insulating material having the characteristics previously described and is secured to the spaced-apart edges of layer 8 along the length of package 10 by suitable means, previously described in regards to the securement of layer 2 to layer 1. A portion of the wall of layer 2 in conjunction with a portion of the wall of layer 8 provides the walls enclosing cavity 4. Third layer 3 is disposed along the length of package 10 on the side of layer 2 that faces away from cavity 4 and is secured to layer 2 by any suitable means such as, for example, a suitably selected adhesive. Layer 3 may be made from any suitable flexible heat resistant material such as a flexible metal or metal-polymeric laminate. In the embodiment shown in FIG. 4, layer 3 is made from a steel.

Figure 5:
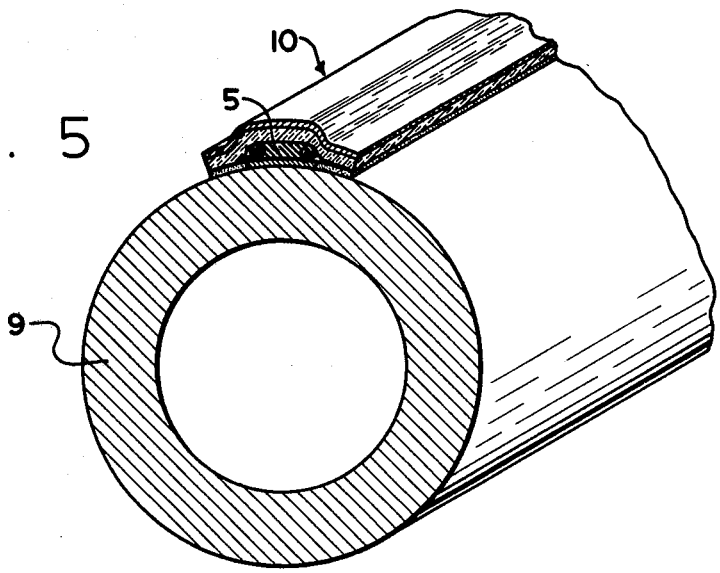
FIG. 5 shows a perspective view of a fragmented section of the embodiment of FIG. 2 secured to a pipe.

FIG. 5 shows the package 10 embodiment of FIG. 2 adhesively secured to the outer surface of pipe 9 as a typical example of the use of the packaged electrical heating element of the invention. As illustrated in FIG. 5, element 5, in the form of a cable, is contained within the package described in regards to FIG. 2 and as such is provided with a previously described heat conducting layer disposed between the heating element and the item to which package 10 is secured as well as providing a previously described heat insulating layer which, in conjunction with the heat conducting layer, enhances the heating efficiency of the heating element while permitting the element to be axially inserted into and withdrawn from the package for replacement and repair without having to remove the package from the item to which it is secured.

Any electrically insulated elongate electrical heating element is suitable for use with the package of the invention provided that the package can be adapted to contain such element. For example, the element may be in the form of one or more high resistance electrical heating wires, constant resistant heating wires and cables, semi-conductive electrical heating cables, mineral filled electrical resistance heating cables commonly known as MI cable, and the like. Semi-conductive heating cables suitable for use with the package of the invention are disclosed, for example, in U.S. Pat. Nos. 2,905,919; 3,793,716 and 3,858,144.

The package of the invention provides a means of containing an electrical heating element in a cavity enclosed by walls a portion of which conducts or controls the amount of heat generated by the element that is transferred to the item to which the package is secured and the balance of which provides a heat insulating layer such that the combination thereof enhances the heating efficiency of the element. The package is able to contain the element prior to the securement of the package to the item to be heated such that both the element and the package can be secured to the item to be heated as a single unit if such is desired. The package of the invention is provided with sufficient flexibility to conform to the surface of the item to which it is secured and contains the element in a cavity extending along the length of the package that has a cross-sectional configuration adaptable to a wide variety of electrical heating elements having a wide variety of cross-sectional shapes as well as permitting the heating element to be axially inserted into and removed from the cavity for replacement or repair without having to remove the package from the item to which it is secured.

What is claimed:

1. An elongate flexible heating package having sufficient flexibility to conform to an item to be heated to which the package is secured and adapted to improve the heating efficiency of an elongate, electrically insulated, electrical heating element contained within the package, said package comprising;

a first layer comprising a wall made from a flexible heat conductive material that extends longitudinally along the length of the package and is adapted to establish a heat contacting relationship to the item to be heated to which the package is secured, a second layer secured along the length of the package to the side of said first layer that faces away from the item to be heated to which the package is secured, said second layer comprising a wall made from a flexible heat insulative material, a third layer secured along the length of the package to the side of said second layer that faces away from said first layer, said third layer comprising a wall made from a flexible heat resistant material that is adapted to protect said second layer, said third layer comprising a metal foil having a mylar film disposed along the length of the package on the side of said third layer that faces away from said second layer, said first, second and third layers being of substantially the same width, and an elongated cavity extending along the length of the package between a portion of said first layer wall and the composite wall comprising a portion of said second and said third layer walls, said cavity containing said electrical heating element and having an open-ended cross-sectional configuration that permits the heating element to be axially inserted into and removed from the cavity for replacement and repair without having to remove the package from the item to be heated to which the package is secured.

2. The package of claim 1 including means for securing the package to the item to be heated, said means adapted to permit the heating element to be inserted into and removed from the cavity without having to remove the package from said item.

3. The package of claim 2 wherein the means for securement comprises a layer of heat conductive adhesive disposed along the length of said package between said first layer and said item and adapted to bond said package to said item.

4. The package of claim 1 wherein said heat conductive first layer material is a metallic material.

5. The package of claim 1 wherein said heat insulative second layer material is a fibrous glass material.

6. The package of claim 1 wherein said heat insulative second layer material is a flexible polymeric foam material.

7. The package of claim 1 wherein said heat resistant third layer material is a metallic material.

8. The package of claim 1 wherein said second layer is secured to said first layer by means of a flexible heat resistant adhesive.

9. The package of claim 1 wherein said third layer is secured to said second layer by means of a flexible heat resistant adhesive.

* * * * *